US005577849A

United States Patent [19]

Durbin et al.

[11] Patent Number: 5,577,849

[45] Date of Patent: Nov. 26, 1996

[54] PRINTING LIGHT INDICIA ON KEYBOARD KEYS

[75] Inventors: William C. Durbin; George N. Powers; Peter E. Wallin, all of Lexington, Ky.

[73] Assignee: Lexmark International, Inc., Lexington, Ky.

[21] Appl. No.: 403,023

[22] Filed: Mar. 13, 1995

[51] Int. Cl.[6] ..... B41J 5/12

[52] U.S. Cl. ..... 400/490; 400/493; 400/494

[58] Field of Search ..... 400/487, 489, 400/490, 493, 494; 200/5 R, 5 A

[56] References Cited

U.S. PATENT DOCUMENTS

| | | | |
|---|---|---|---|
| 4,341,689 | 7/1982 | Doshi et al. | 523/211 |
| 4,776,270 | 10/1988 | Kumamoto | 101/35 |
| 4,903,601 | 2/1990 | Fukui | 101/488 |
| 4,980,221 | 12/1990 | Kobayashi et al. | 428/195 |

*Primary Examiner*—Christopher A. Bennett
*Attorney, Agent, or Firm*—John A. Brady

[57] ABSTRACT

A polyol polyester and hexamethylene diisocyanate in a fluid mixture with white pigment, silicon glycol surfactant and thinner are pad printed on keyboard key to print characters and symbols which require no protective overcoat.

4 Claims, No Drawings

PRINTING LIGHT INDICIA ON KEYBOARD KEYS

TECHNICAL FIELD

This invention relates to keyboards, more specifically to the printing on keys of keyboards when sublimation printing is not available, as in printing white indicia on dark keys.

BACKGROUND OF THE INVENTION

One critical procedure in the manufacture of computer keyboards is decorating. This is the application of letters and numbers on the keyboard. The graphics cannot wear off during the useful life of the keyboard. This is a challenging objective because of normal abrasion from finger typing and chemical attack, such as from hand creams.

The undisputed best method for decorating keyboards is dye-sublimation. This process involves impregnating the plastic with a dye to form the character. Thus, the plastic must be worn away before the character will wear. However, dye-sublimation can only be used to place darker characters on a lighter substrate, such as black characters on white keys because a white sublimation dye does not exist. This is not a problem for standard keyboards, but notebook computer keyboards are frequently black with white characters. Also, some designs of desktop keyboards call for black keys with white characters.

The most popular and economic technique of decorating black keyboards is pad printing. However, the inks used in pad printing are typically not abrasion or chemical resistant. Therefore, most manufacturers apply a protective clear coating of polyurethane to protect the graphics from wear and chemical attack. This protective coating is expensive and difficult to apply. Most pad printing inks are made from thermoplastic materials like polyvinylchloride, which are dissolved in a solvent. Since such materials are not reactive, they have infinite pot life as long as the operator continues to add solvent. But these materials are inherently poor against chemical attack and abrasion, and because they are not reactive, they often do not adhere to the substrate well. They are mainly chosen for their pot life and quick drying capabilities and were never designed for a high wear environment like the keyboard application. Still, there are many commercially available reactive epoxy and polyurethane pad printing inks which have better chemical and abrasion resistance than the thermoplastic inks, but are still not as good as the coated indicia. This invention involves the creation of a polyurethane based pad printing ink which is far superior to any other commercially available pad printing ink and which is better than or equal to many protective clear coatings. The formulation used is similar to that used by automobile companies for the protective overcoat of automobiles. Hexamethylene diisocyanate/polyester polyurethanes, as are used in this invention, are considered to be the most abrasion resistant class of polyurethane. This invention effectively uses the protective clearcoat polymer and incorporates it into the pad print ink, thus eliminating the need for a protective clearcoat over the characters of a keyboard.

U.S. Pat. No. 4,776,270 to Kumamoto is to a reactive ink on a keyboard key with no overcoat. However, the reaction is driven by ultraviolet light and the material is not a urethane. U.S. Pat. No. 4,341,689 to Doshi et al is to a reactive urethane system, which mentions the inclusion of pigments, but not in the context of keyboard printing. U.S. Pat. No. 4,980,221 to Kobayashi et al and U.S. Pat. No. 4,903,601 to Fukui are to keyboard printing with urethane inks, but not reactive inks.

DISCLOSURE OF THE INVENTION

In accordance with this invention printing on keyboard keys is effected with an ink having a polyester polyol and an alkyl diisocyanate, as well as a white pigment. A silicon glycol surfactant is added to improve wetting and to smooth the surface of the final printing. The reaction to form a polyester urethane proceeds without human intervention and typically is completed within one hour at 120° C. The final printing is firmly bonded to the top of the keybutton to which it was applied. The invention has demonstrated far superior wear characteristics than many other inks in the pad printing industry and equal to or superior wear performance to some protective clear coatings.

BEST MODE FOR CARRYING OUT THE INVENTION

The specific formulation for the preferred embodiment of a white ink is as follows:

| Material | Percent by Wt. |
|---|---|
| Desmophen 650A-65 polyol polyester resin (saturated 65 + or −3% wt. solids in propylene glycol monomethyl ether acetate and xylene) (trademark Mobay Corp.) | 33.9 |
| Desmodur N-3200 hexamethylene diisocyanate (trademark Mobay Corp.} | 20.4 |
| Titanium dioxide, powder, 2 micron (product of Du Pont Corp.) | 30.5 |
| Dow Corning 29 additive, reactive silicone glycol surfactant | 0.28 |
| VD thinner solvent blend comprising 25% cyclohexahone, 25% butylacetate, 50% naphtha (trademark Transtech Co.) | 14.92 |

The titanium dioxide makes the ink white. Other filler would be added to obtain any color desired. The additive 11 improves pigment dispersibility and wetting of the key surface, and smoothness to be final ink surface (smoothness minimizes transfer, known as blocking.) The thinner is for viscosity and evaporation rate adjustment to that best for best printing.

The keybutton itself may be virtually any molded plastic, for example ABS or polycarbonate. Such plastic have inherent minute surface roughness, which promotes adhesion of the final printing to the surface. Other materials, such as metal surfaces, should function well as they are compatible with polyurethane. The ink is poured into a substrate which has the character or symbol etched into it. The pad is then pressed to the substrate to wet it and then touched to the keybutton. The pad surface is selected to have a lower surface energy than that of the keybutton surface, and the ink therefore transfers to the key surface. Preferably, each key button is printed in two, identical cycles to improve the image by adding the thickness of printing.

In accordance with this invention, the ink hardens completely within 24 hours into a layer of polyester isocyanate having the titanium dioxide and additive dispersed throughout the polyester isocyanate. Ultraviolet treatment and other chemical activators may be employed to increase hardening time, since unfinished keyboard require valuable space.

However, addition of such chemical activators will reduce pot life or working time of the ink.

A wide variety of commercial reactive pad printing inks were tested for abrasion resistance and compared to the results of this invention. Also, these materials were tested for chemical resistance by immersing them in methyethylketone at room temperature for 24 hours and measuring the % swell. Also, several sets of acrylonitrile-butadiene-styrene key buttons were made from the best pad printing inks, a standard keybutton ink, manual clearcoating, and ultraviolet clearcoating. These buttons were compared against each other for abrasion resistance in an eraser abrasion tester. The button material severely affects the absolute results, but the trends in which ink is more abrasion resistant are not obscured. The invention is less abrasion resistance to only the ultraviolet clearcoat, which is expensive and difficult to apply and which exceed with respect to abrasion resistance the requirements by twice as many operations.

This invention yields a clear cost advantage for the wear performance achieved. Comparable pad printing inks are not known to exist. Accordingly, the following claims are presented.

We claim:

1. A keyboard comprising a plurality of molded plastic keybuttons, said keybuttons being dark in color and having light in color characters or symbols as an outer layer of polyester urethane which is the reaction product of a polyol polyester and hexamethylene diisocyanate holding metal oxide pigment dispersed through said layer and forming said characters or symbols.

2. The keyboard as in claim 1 also comprising a minor amount of a silicone glycol surfactant.

3. A keyboard comprising a plurality of keybuttons, said keybuttons being dark in color and having light in color characters or symbols as an outer layer of polyester urethane formed by reaction of a polyol polyester and an alkyl diisocyanate on the surface of said keybuttons holding pigment and a minor amount of a silicone glycol surfactant dispersed through said layer and forming said characters or symbols.

4. The keyboard as in claim 3, in which said polyester urethane is a condensation product of said polyol polyester and hexamethylene diisocyanate.

* * * * *